US007358980B2

(12) United States Patent
Larson

(10) Patent No.: US 7,358,980 B2
(45) Date of Patent: Apr. 15, 2008

(54) IMAGING DEVICE AND METHODS

(75) Inventor: Bradley R. Larson, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 438 days.

(21) Appl. No.: 11/041,775

(22) Filed: Jan. 24, 2005

(65) Prior Publication Data

US 2006/0165420 A1 Jul. 27, 2006

(51) Int. Cl.
*B41J 2/535* (2006.01)
*B41J 2/45* (2006.01)

(52) U.S. Cl. ..... 347/131

(58) Field of Classification Search ..... 347/112, 347/129, 130, 131, 225, 233; 399/1, 3, 4
See application file for complete search history.

(56) References Cited

U.S. PATENT DOCUMENTS

| | | | | |
|---|---|---|---|---|
| 5,818,504 | A * | 10/1998 | Chung et al. | 347/251 |
| 5,835,123 | A * | 11/1998 | Chung et al. | 347/251 |
| 6,108,501 | A | 8/2000 | Nagai | |
| 6,134,022 | A | 10/2000 | Yamamoto et al. | |
| 6,198,495 | B1 | 3/2001 | Sawada | |
| 6,198,896 | B1 | 3/2001 | Nakayasu et al. | |
| 6,731,321 | B2 | 5/2004 | Sumi | |
| 6,744,994 | B2 | 6/2004 | Yoshikawa et al. | |
| 2004/0150708 | A1 | 8/2004 | Cervantes | |

* cited by examiner

*Primary Examiner*—Huan Tran

(57) ABSTRACT

In an embodiment, a region of a photoconductor is exposed to light having an intensity below a threshold sufficient to produce a marking-material-free region or a marking material containing region.

87 Claims, 5 Drawing Sheets

IMAGING DEVICE AND METHODS

BACKGROUND

Certain printed image features can benefit from high printing resolution, such as solid lines, curves, fonts, etc. with very high contrast edges. High resolution is often expensive and sometimes can degrade other aspects of image quality. High resolution also often comes with a reduction in print speed. Electrophotographic printers, for example, typically utilize either a laser scanning system or an LED (light emitting diode) bar-based system to expose regions of toner on a rotating photoconductor drum for developing the toner in these regions to form an image. The resolution of these printers generally will not exceed a frequency at which the laser scans the drum or to the density of the LEDs of the LED bar.

DETAILED DESCRIPTION

In the following detailed description of the present embodiments, reference is made to the accompanying drawings that form a part here of, and in which is shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

Figure 1:
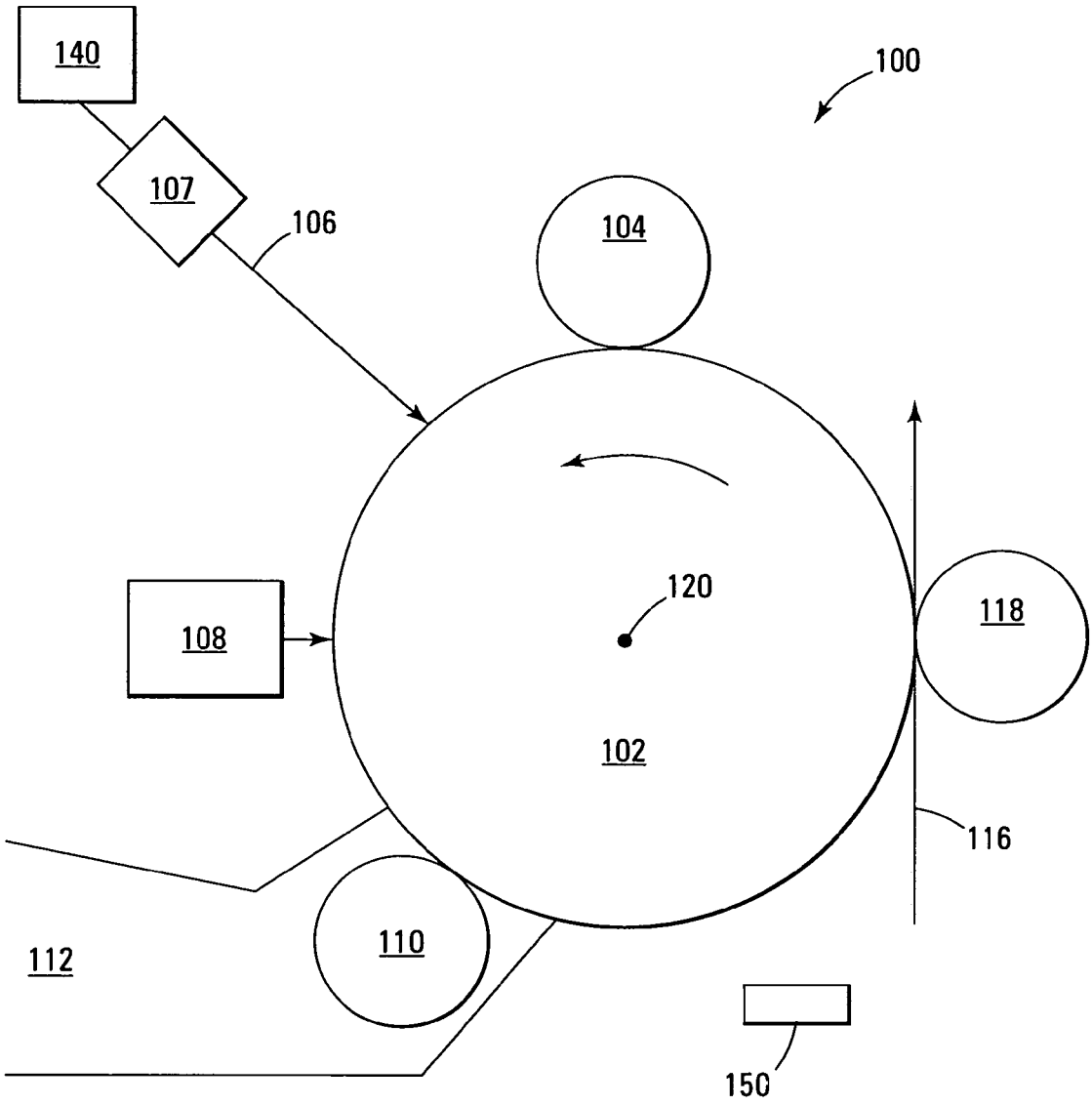
FIGS. 1 and 2 are respectively end and top views of a portion of an embodiment of an imaging device, according to an embodiment of the present disclosure.
Figure 2:
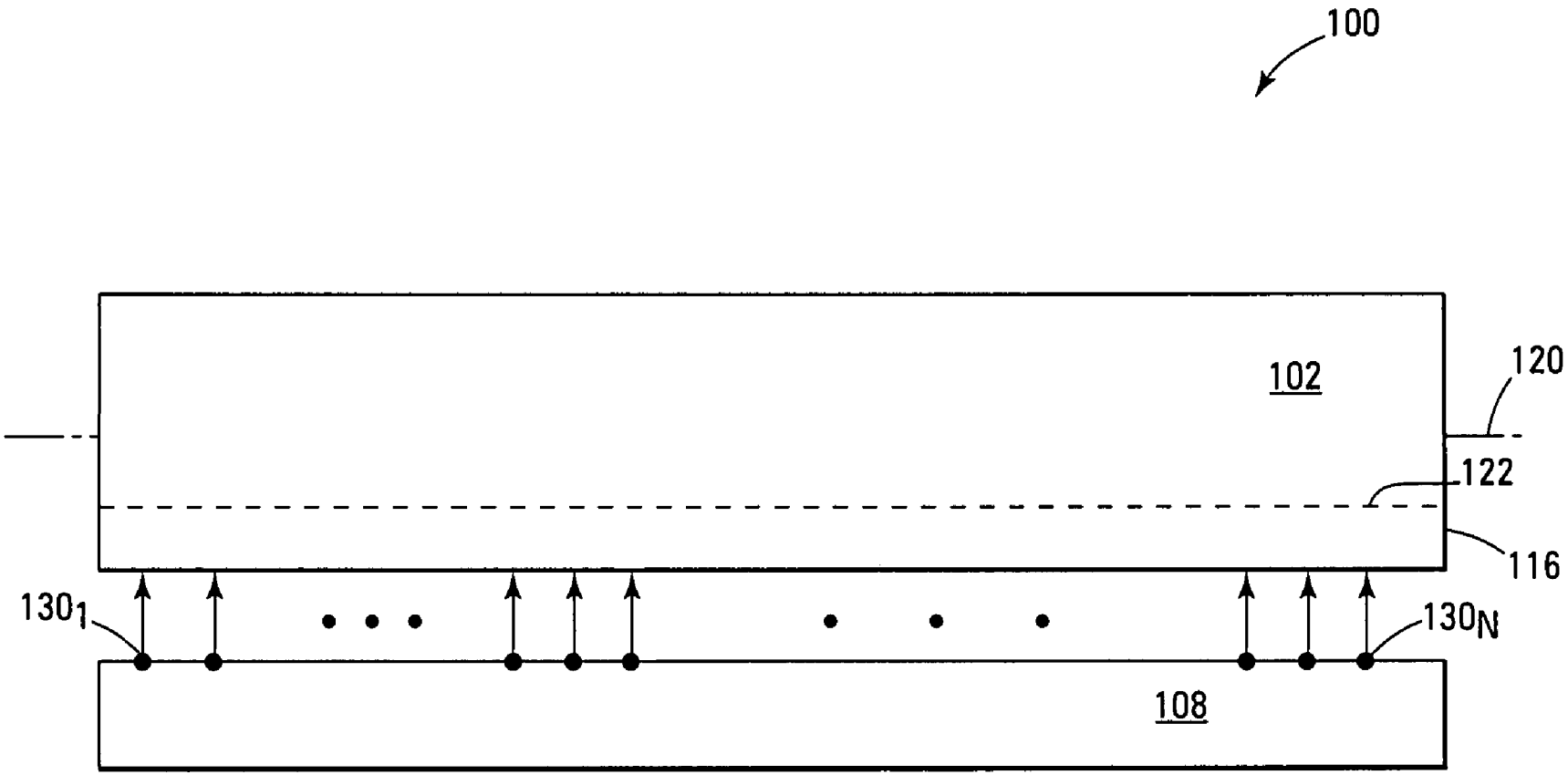

FIGS. 1 and 2 are respectively end and top views of a portion, e.g., a print engine 100, of an electrographic imaging device, according to an embodiment. Print engine 100 includes a photoconductor drum 102. For one embodiment, as photoconductor drum 102 rotates in the direction shown, a charge roller 104 rotates in contact with photoconductor drum 102 to charge photoconductor drum 102 to a substantially uniform charge. After photoconductor drum 102 is charged, light from a light beam, such as a laser beam 106 from laser 107, and/or a light-emitting-diode (LED) bar 108 is directed at preselected locations on photoconductor drum 102 to create discharged regions at those locations. A developer roller 110, for another embodiment, also rotates in contact with photoconductor drum 102. Developer roller 10 is coated with charged toner, or other charged marking material, from a toner supply 112. The toner is attracted to the discharged regions due to a charge differential, whereas the toner is substantially not attracted to the charged regions. For this embodiment, the regions of photoconductor drum 102 exposed to the light correspond to the image areas. Conversely, for other embodiments, the photoconductor drum 102 is still charged, and the light received at the preselected regions creates discharged regions at these locations, however, the exposed regions represent the background rather than the image areas. For these embodiments, toner from developer roller 110 is attracted to the charged regions that have not been exposed to the light and repelled by those regions that have been exposed to the light.

The regions of photoconductor drum 102 that attract the toner form an image on photoconductor drum 102. The image is then transferred on to a media sheet 116, such as paper, plastic, etc., that for one embodiment passes through a nip between photoconductor drum 102 and a transfer roller 118, where heat and/or pressure are applied thereto to fuse the toner onto media sheet 116. For other embodiments, the toner is transferred to an intermediate transfer belt (not shown, but located where media sheet 116 is located) that in turn transfers the toner to the media and then fuses it.

For one embodiment, laser beam 106 scans photoconductor drum 102 parallel to a rotational axis 120 of photoconductor drum 102 along a scan line 122 (FIG. 2), i.e., perpendicular to the rotation of the drum. For some embodiments, reflecting laser beam 106 off a rotating mirror (not shown) accomplishes the scan. Laser beam 106 is modulated along scan line 122 to illuminate photoconductor drum 102 at preselected locations along scan line 122. Photoconductor drum 102 is rotated so that another portion of photoconductor drum 102 is aligned with scan line 122, and laser beam 106 scans photoconductor drum 102 parallel to the preceding scan. This continues to create a number of parallel laser scans on photoconductor drum 102, indicated as laser scan centerlines (or axes) in FIG. 3, according to another embodiment.

For another embodiment, a pulse width modulator (PWM) 140 (shown in FIG. 1) drives the laser used to produce the laser beam. This enables the generation of laser light pulses that illuminate portions of the photoconductor drum 102, in a direction parallel to rotational axis 120, for a shorter time than it takes to illuminate an entire native pixel size, parallel to rotational axis 120, of the laser, i.e., that corresponds to operating the laser alone, resulting in sub-pixel size exposures in a direction parallel to rotational axis 120. Moreover, this enables a laser illumination to be moved in a direction parallel to rotational axis 120 anywhere within the native pixel of the laser.

LED bar 108 is mounted parallel to rotational axis 120, and may be placed either immediately before or after scan line 122. LEDs 130 are distributed along LED bar 108 parallel to rotational axis 120. LEDs 130 are modulated to illuminate photoconductor drum 102 at preselected locations as photoconductor drum 102 rotates past LED bar 108 and therefore illuminate the drum in a direction perpendicular to scan line 122 to create an LED scan in the direction of rotation of photoconductor drum 102, indicated as parallel LED scan centerlines (or axes) in FIG. 3. Note that each LED scan shown in FIG. 3 corresponds to a location of an LED 130 of LED bar 108. Also note that the LED scans are substantially perpendicular to the laser scans. Moreover, the LED scans intersect the laser scans.

For one embodiment, each of the LEDs 130 can be modulated to so that they illuminate portions of the photoconductor drum 102, in a direction perpendicular to rotational axis 120, for a shorter time than it takes to illuminate an entire native pixel size, perpendicular to rotational axis 120, of the LED scan, i.e., that corresponds to operating the LED bar alone, resulting in sub-pixel size exposures in a direction perpendicular to rotational axis 120. Moreover, this enables an LED illumination to be moved in a direction perpendicular to rotational axis 120 anywhere within a native pixel of the LED scan.

Figure 3:
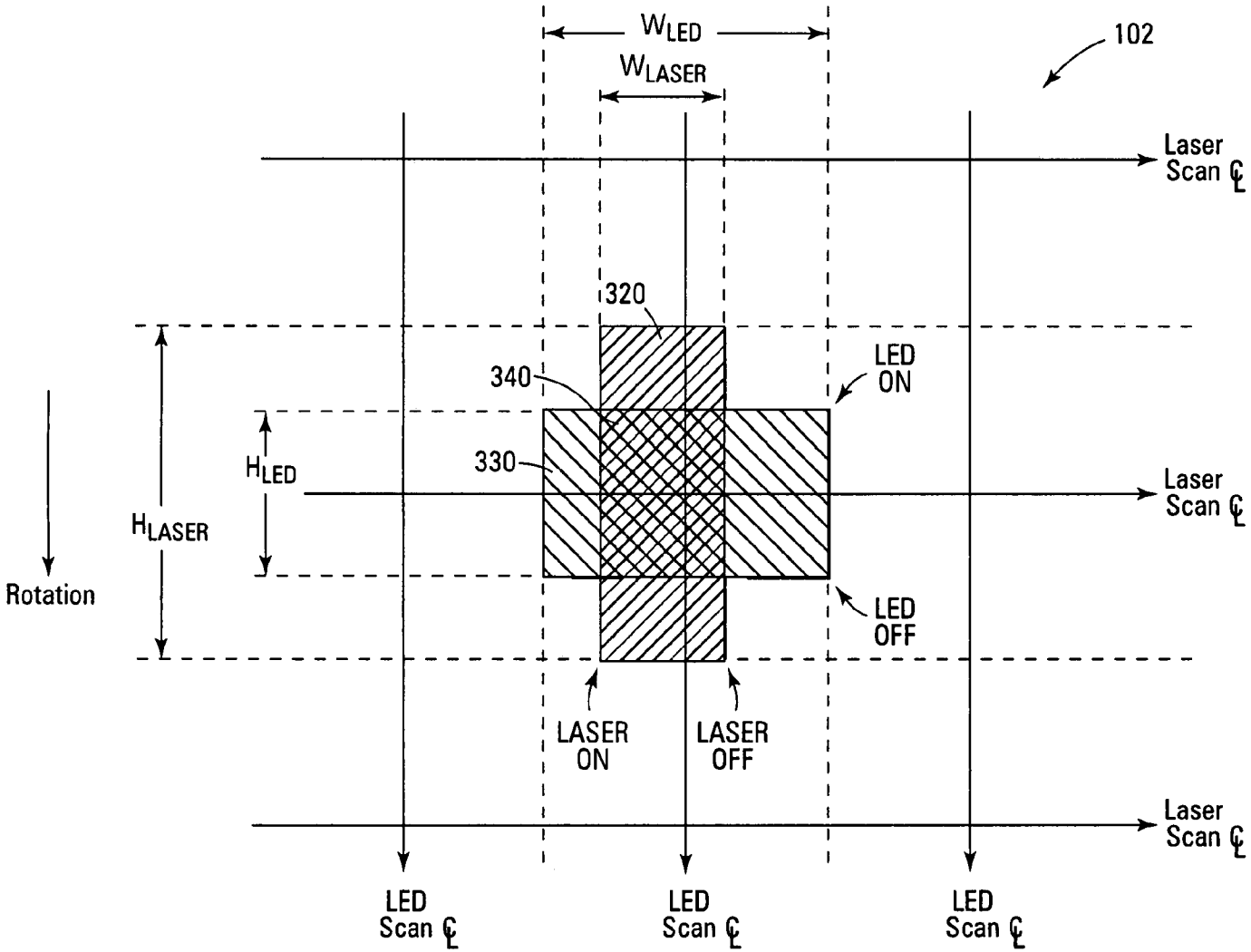
FIG. 3 illustrates illuminating an embodiment of a photoconductor, according to another embodiment of the present disclosure.

In FIG. 3, cross-hatched region 320 is illuminated by the laser scan, and cross-hatched region 330 is illuminated by the LED scan and corresponds to a pixel of the LED scan. The LED and laser illuminations overlap in cross-hatched region 340. That is, cross-hatched region 340 is illuminated twice.

The extent ($H_{Laser}$) of cross-hatched region 320 in the direction perpendicular to the laser scan is fixed, as is the extent ($W_{LED}$) of cross-hatched region 330 in the direction perpendicular to the LED scan, as shown in FIG. 3. Moreover, cross-hatched regions 320 and 330 are respectively substantially symmetrical about their scan centerlines. However, the extent ($W_{Laser}$) of crossed hatched region 320 in the direction of the laser scan and the extent ($H_{LED}$) of crossed hatched region 330 in the direction of the LED scan can be varied by respectively modulating the laser and the corresponding LED, for some embodiments, as shown in FIG. 3. Moreover, for other embodiments, cross-hatched region 320 can be located asymmetrically about an LED scan centerline, as shown in FIG. 3, by appropriately modulating the laser. For another embodiment, cross-hatched region 330 can be located asymmetrically about a laser scan centerline (not shown), by appropriately modulating the corresponding LED. Note that the extent ($W_{Laser}$) of crossed hatched region 320 in the direction of the laser scan can be made less than the extent of the native pixel for the laser scan in the direction of the laser scan by modulating the laser, as described above, and/or the extent ($H_{LED}$) of crossed hatched region 330 in the direction of the LED scan can be made less than the extent of the native pixel in the direction of the LED scan by modulating the corresponding LED, as described above.

The laser and LED illuminations are each at intensity levels below a threshold at which toner is attracted to the non-overlapping portions of cross-hatched regions 320 and 330. That is, when photoconductor drum 102 is substantially uniformly charged, the individual laser and LED illuminations are insufficient to discharge the non-overlapping portions of cross-hatched regions 320 and 330, respectively, to a level for attracting toner. However, the combined intensities of laser and LED illuminations are sufficient to discharge photoconductor drum 102 to attract the toner. Therefore, cross-hatched region 340, where the two illuminations overlap, is sufficiently discharged to attract toner but not the areas of region 320 and region 330 that are not. Consequently, a dot of toner is formed in cross-hatched region 340.

Note that toner is repelled by the regions illuminated by the laser scan, without illumination by the LED scan, and illuminated by the LED scan, without illumination by the laser scan. Note further that the toner dot corresponding to cross-hatched region 340 is smaller than cross-hatched region 320 and cross-hatched region 330. This means that for one embodiment overlapping the LED and laser scans can produce a region that is smaller than the regions of the individual LED and laser scans.

Alternatively, in embodiments where the exposed regions correspond to the regions upon which toner is not to be deposited, the photoconductor drum 102 is charged, and the intensity levels of individual laser and LED illuminations are insufficient to respectively discharge the non-overlapping portions of cross-hatched regions 320 and 330 to a level for repelling toner. However, the combined intensities of laser and LED illuminations are sufficient to discharge the photoconductor drum 102 to a level so that it repels the toner. Therefore, the cross-hatched region 340, where the two illuminations overlap, is discharged to a level that is sufficient to repel toner, but not the areas of region 320 and region 330 that are not. Consequently, a toner-free dot (i.e. a dot without toner) is formed in the overlapping portions of cross-hatched regions 320 and 330 that is surrounded by toner in the regions not exposed to laser and LED illumination and in the non-overlapping portions of cross-hatched regions 320 and 330. The regions not exposed to laser and LED illumination and in the non-overlapping portions of cross-hatched regions 320 and 330 correspond to toner dots. Note that the toner-free dot corresponding to cross-hatched region 340 is smaller than cross-hatched region 320 and cross-hatched region 330.

One advantage of cross-hatched region 340 being smaller than cross-hatched region 320 and cross-hatched region 330 is that a laser-based imaging device, for example, can be upgraded by adding an LED bar to increase the resolution. In another example, a 600 dpi imaging device could be made with a 300 dpi (or 150 dpi) LED bar and a 300 dpi (or 150 dpi) laser scanner assembly.

Another advantage is that overlapping regions respectively produced by the laser and LED scans may act to produce high resolution edge definition, which is desirable for producing fine edges and lines, e.g., that can occur in highly detailed drawings, such as CAD drawings produced by industrial digital presses, for example. The minimum amount of data is generally about the same as the native resolution of the device dictate, e.g., the resolution of a laser-based device by itself. Additional data would be used to define the higher resolution edge locations and shape. This could be accomplished as an additional plane of low-bit-depth data (i.e., 1-bit/pixel) or embedded codes in the image data, etc. The amount of this data could be defined by the application and could be increased when desired.

In order to overlap the laser and LED scans as desired, the laser and LED scans are calibrated and aligned to one another. Printing a first set of patterns on a media sheet using the laser scan, without the LED scan, and printing a separate second set of patterns on either a different portion of the same media sheet or on a different media sheet using the LED scan, without the laser scan, helps to accomplish this for one embodiment. Note that the individual intensities of the laser beam and LED are set to a levels sufficient for printing, i.e., at levels sufficient so that toner is either attracted or repelled from regions exposed to the laser or LED light, for this process. For another embodiment, sensors, such as a sensor 150 of FIG. 1, of print engine 100 scan the first and second patterns for the locations of toner-containing pixels of the respective scans. For other embodiments, the sensor scans either photoconductor drum 102 directly or the transfer belt (not shown) for the pixels of the first and second patterns resulting from the respective scans. Note that for these embodiments, scanning of the patterns may be done without printing out the first and second patterns on one or more media sheets. Note further that the patterns are formed so that they are displaced from each other to keep track of which scan, the laser scan or the LED scan, formed which pattern.

It should be noted that for some embodiments, photoconductor drum 102 may be scanned by laser beam 106 without using LED bar 108 or by LED bar 108 without using laser beam 106. For these embodiments, the laser beam 106 or LED bar 108 is at an intensity that is at or above a threshold sufficient to produce marking-material-free regions or marking-material-containing regions on photoconductor drum 102.

Figure 4:
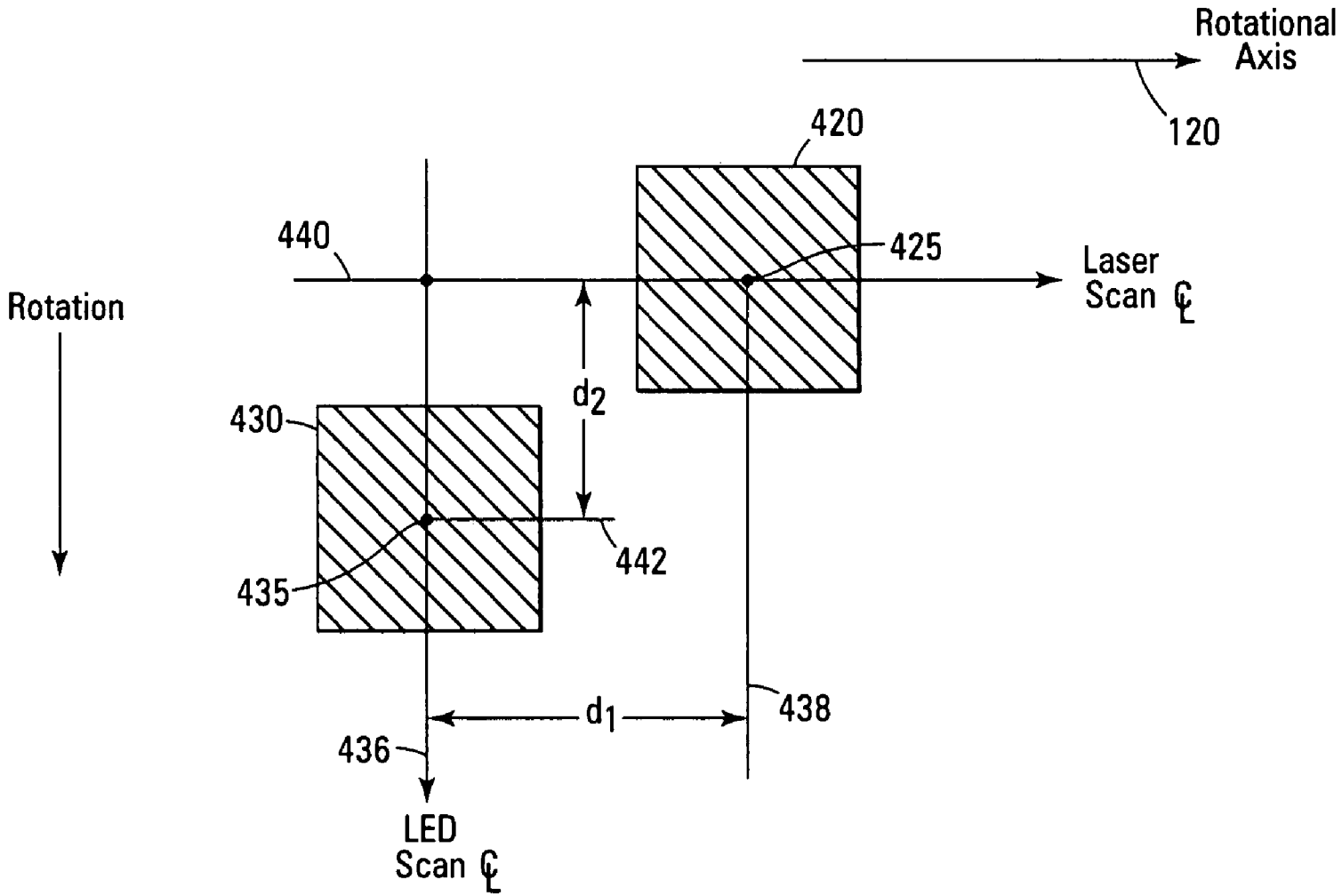
FIG. 4 illustrates locations of pixels formed by different scans of an embodiment of a photoconductor, according to another embodiment of the present disclosure.

FIG. 4 illustrates the locations of a toner-containing (or toner-free) region 420 of the first set of patterns printed by the laser scan and a corresponding toner-containing (or toner-free) region 430 of the second set of patterns printed by the LED scan, identified by the sensors, superposed on photoconductor drum 102, according to another embodiment. That is, FIG. 4 shows where regions 420 and 430 would occur on photoconductor drum 102 if they were obtained from using the laser and LED scans together. Note that regions 420 and 430 may be the size of pixels produced respectively by the laser and LED scans or may be made smaller than these pixels by modulating the laser and LEDs. For one embodiment, superposing the individually scanned regions 420 and 430 on the drum, as in FIG. 4, e.g., from the one or more media sheets, the transfer belt, or the photoconductor drum 102, is accomplished by mapping their locations to a common coordinate system of the surface of photoconductor drum 102.

It is desired for one embodiment that at least a portion of region 420 overlaps at least a portion of region 430, e.g., in one embodiment, that a center 425 of region 420 coincides with a center 435 of region 430. The locations of regions 420 and 430 enable the determination of a difference $d_1$, in the direction of the rotational axis 120 of photoconductor drum 102 (or axial direction), between a line 436 passing through the center 435 of region 430 in the direction perpendicular to the rotational axis 120 (the rotational direction) and a line 438 substantially parallel to line 436 and passing through the center 425 of region 420. A difference $d_2$, in the rotational direction of photoconductor drum 102, between a line 440 passing through the center 425 of region 420 in the axial direction and a line 442 substantially parallel to line 440 and passing through the center 435 of region 430 is similarly determined. For one embodiment, mapping the locations of the individually scanned regions 420 and 430 to a common coordinate system of the surface of photoconductor drum 102, as described above enables the differences $d_1$ and $d_2$ to be determined and thus whether at least a portion of the individually scanned regions 420 and 430 overlap in a predetermined manner on photoconductor drum 102.

To compensate for the difference $d_1$, the time at which a source of laser beam 106 is activated to illuminate the portion of photoconductor drum 102 for forming region 420 is adjusted so that lines 436 and 438 substantially coincide. Note that for the example of FIG. 4, the activation of the source of laser beam 106 would be advanced, which would correspond to activation of the source of laser beam 106 earlier in time. To compensate for the difference $d_2$, the time at which the LED 130 (FIG. 2) is activated to illuminate the portion of photoconductor drum 102 for forming region 430 is adjusted so that lines 440 and 442 substantially coincide. Note that for the example of FIG. 4, the activation of the LED 130 would be delayed, which would correspond to activation of the LED 130 later in time.

Once this alignment or calibration is complete, the controlling system can cooperatively modulate the two illumination sources in order to create the desired overlapping regions on the finer pixel grid, as described previously. The systems which drive these exposures will interpret a high resolution version of the desired image and separate it into two streams of data, one driving the LED sub-system and one driving the laser sub-system. These can each be generated in concert to create the desired overlapping exposures.

Figure 5:
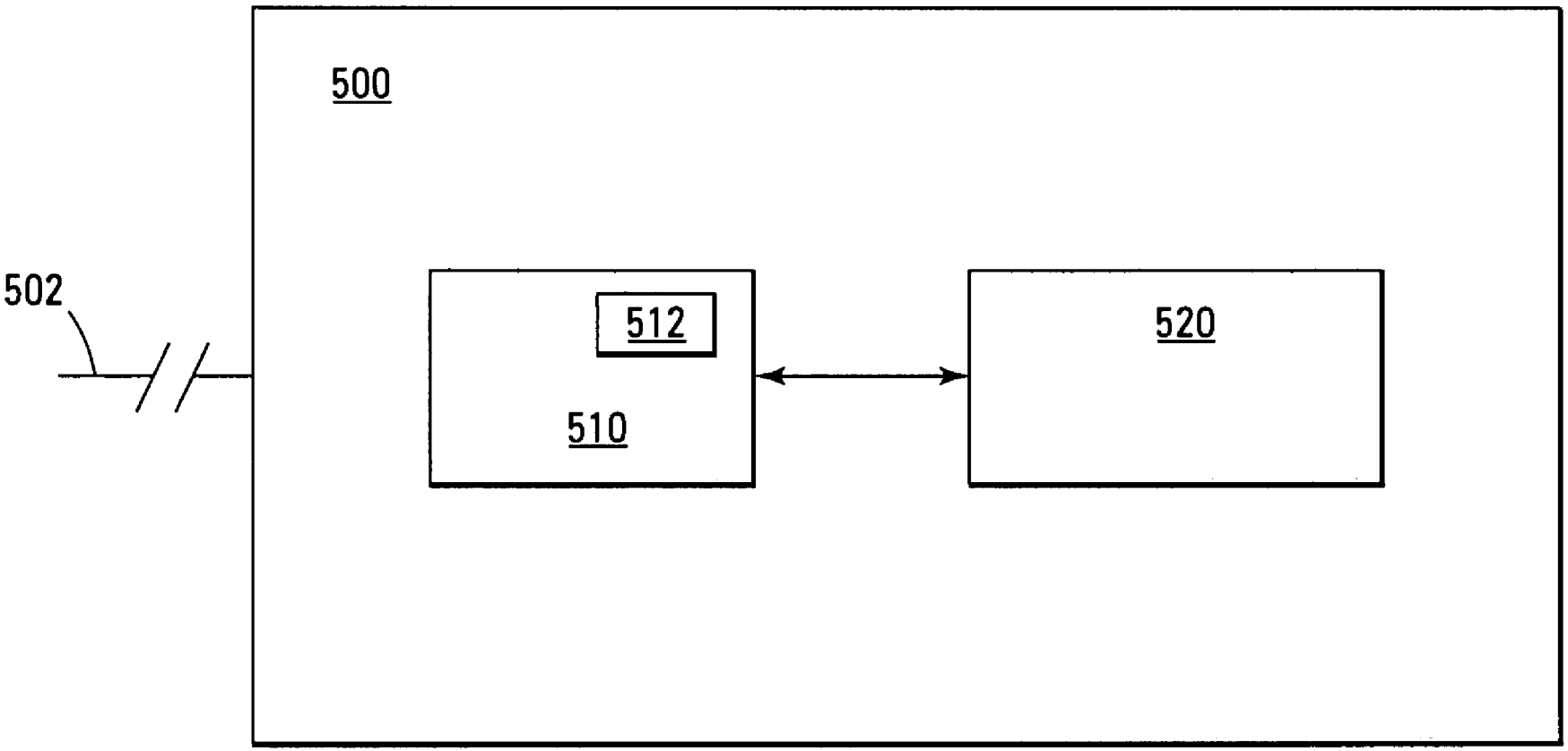
FIG. 5 is a block diagram of an embodiment of an imaging device, according to another embodiment of the present disclosure.

FIG. 5 is a block diagram of an electrographic imaging device 500, according to another embodiment. Imaging device 500 can be a printer, and industrial digital printing press, a copier, digital network copier, a multi-function peripheral (MFP), a facsimile machine, etc. Imaging device 500 may be connected directly to a personal computer, workstation, or other processor-based device system, or to a data network, such as a local area network (LAN), the Internet, a telephone network, etc., via an interface 502.

For one embodiment imaging device 500, receives image data via interface 502. Imaging device 500 has a controller 510, such as a formatter, for interpreting the image data and rendering the image data into a printable image. The printable image is provided to a print engine 520 to produce a hardcopy image on a media sheet. For one embodiment, print engine 520 is as described above for print engine 100 of FIGS. 1 and 2. For another embodiment, the imaging device 500 is capable of generating its own image data, e.g., a copier via scanning an original hardcopy image.

Controller 510 includes a memory 512, e.g., a computer-usable storage media that can be fixedly or removably attached to controller 510. Some examples of computer-usable media include static or dynamic random access memory (SRAM or DRAM), read-only memory (ROM), electrically-erasable programmable ROM (EEPROM or flash memory), magnetic media and optical media, whether permanent or removable. Memory 512 may include more than one type of computer-usable storage media for storage of differing information types. For one embodiment, memory 512 contains computer-readable instructions, e.g., drivers, adapted to cause controller 510 to format the data received by imaging device 500, via interface 502 or by scanning, and computer-readable instructions to cause imaging device 500 to perform the various methods described above.

CONCLUSION

Although specific embodiments have been illustrated and described herein it is manifestly intended that the scope of the claimed subject matter be limited only by the following claims and equivalents thereof.

What is claimed is:

1. An imaging method comprising:

forming one or more marking-material-free regions or one or more marking-material-containing regions on a photoconductor at locations of the photoconductor that have been exposed at least twice to light having an intensity below a threshold sufficient to produce a marking-material-free region or a marking material containing region.

2. The method of claim 1, wherein the locations of the photoconductor that have been exposed to light at least twice are exposed to substantially perpendicular scans of light.

3. The method of claim 2, wherein one of the scans of light is a laser scan and another of the scans of light is a light-emitting-diode scan.

4. The method of claim 3, wherein the laser scan comprises modulating a laser beam.

5. The method of claim 3, wherein the light-emitting-diode scan comprises modulating light emitting diodes.

6. The method of claim 1, wherein the photoconductor is disposed on a rotatable drum.

7. The method of claim 1, wherein forming one or more marking-material-free regions further comprises repelling the marking-material from the locations of the photoconductor that have been exposed to light at least twice.

8. The method of claim 1, wherein forming one or more marking-material-containing regions further comprises attracting the marking material to the locations of the photoconductor that have been exposed to light at least twice.

9. A method, comprising:

illuminating a region of a photoconductor with light emitting diode (LED) light with an intensity insufficient for attracting toner; and illuminating at least part of the region of the photoconductor illuminated with the light emitting diode light with laser light.

10. The method of claim 9, further comprises depositing marking material onto the at least part of the region of the photoconductor illuminated by the LED light and the laser light.

11. The method of claim 9, wherein the laser light illumination is done before the LED illumination.

12. The method of claim 9, wherein the LED illumination is done before the laser light illumination.

13. The method of claim 9 further comprises depositing marking material onto areas of the photoconductor that have not been illuminated by the LED light and laser light.

14. The method of claim 9, wherein illuminating the region of the photoconductor illuminated with the light emitting diode light with the laser light includes using an intensity of the laser light to cause discharge insufficient for depositing marking material on a part of the region of the photoconductor exposed to the laser light but not exposed to the LED light.

15. The method of claim 9, wherein illuminating the region of the photoconductor with the LED light includes using an intensity of the LED light to cause discharge insufficient for depositing marking material on a part of the region of the photoconductor exposed to the LED light but not exposed to the laser light.

16. The method of claim 9, wherein a scan axis of the laser light and a scan axis of the LED light are substantially perpendicular.

17. The method of claim 9, wherein the photoconductor includes a photoconductor drum with a scan axis of the laser light parallel to a photoconductor drum axis and a scan axis of the LED light perpendicular to the photoconductor drum axis.

18. An imaging method comprising:

illuminating one or more first regions of a photoconductor at a first illumination level less than an illumination level for depositing marking material on the photoconductor; and illuminating one or more second regions of the photoconductor at a second illumination level less than the illumination level for depositing the marking material on the photoconductor, wherein at least a portion of each of the one or more first and second regions overlap.

19. The method of claim 18, wherein the illuminating one or more first regions of a photoconductor further comprises using a laser beam.

20. The method of claim 19, wherein the illuminating one or more first regions of a photoconductor further comprises modulating the laser beam to control a size of the one or more first regions and/or to control a location of the one or more first regions relative to the one or more second regions.

21. The method of claim 19, wherein the illuminating one or more second regions of a photoconductor further comprises using light emitting diodes.

22. The method of claim 21, wherein the illuminating one or more second regions of a photoconductor further comprises modulating the light emitting diodes to control a size of the one or more second regions and/or to control a location of the one or more second regions relative to the one or more first regions.

23. The method of claim 18, wherein the photoconductor is disposed on a rotatable drum.

24. The method of claim 23, wherein the illuminating one or more first regions of a photoconductor further comprises scanning the photoconductor in a direction parallel to a rotational axis of the drum.

25. The method of claim 24, wherein the illuminating one or more second regions of a photoconductor comprises scanning the photoconductor in a direction perpendicular to the rotational axis of the drum.

26. The method of claim 18, wherein the first and second illumination levels of the overlapped portion of each of the one or more first and second regions combine to equal or exceed the illumination level for depositing marking material on the photoconductor.

27. The method of claim 26 further comprises depositing marking material adjacent the overlapped portion of each of the one or more first and second regions.

28. The method of claim 27, wherein depositing marking material adjacent the overlapped portion of each of the one or more first and second regions comprises the marking material being repelled from the overlapped portion of each of the one or more first and second regions and attracted to non-overlapping portions of each of the one or more first and second regions and adjacent regions that have not been illuminated.

29. The method of claim 26 further comprises depositing marking material onto the overlapped portion of each of the one or more first and second regions.

30. The method of claim 29, wherein depositing marking material onto the overlapped portion of each of the one or more first and second regions comprises the marking material being attracted to the overlapped portion of each of the one or more first and second regions.

31. An imaging method comprising:

illuminating one or more first regions of a photoconductor drum at a first illumination level less than an illumination level for attracting a marking material by scanning the photoconductor drum parallel to a rotational axis of the drum using a first light source; and illuminating one or more second regions of the photoconductor drum at a second illumination level less than the illumination level for attracting the marking material by rotating the drum past a second light source so that the drum is scanned in a direction substantially perpendicular to the rotational axis, wherein at least a portion of each of the one or more first and second regions overlap.

32. The method of claim 31, wherein the first and second illumination levels of the overlapped portion of each of the one or more first and second regions combine to produce an illumination level sufficient for attracting the marking material.

33. The method of claim 31, wherein the first light source is a laser beam.

34. The method of claim 31, wherein the second light source comprises a plurality of light emitting diodes, wherein one or more of the light emitting diodes respectively illuminate the one or more second regions of the photoconductor drum.

35. The method of claim 31, wherein illuminating the one or more first regions further comprises modulating the first light source for controlling a size and/or location of the one or more first regions.

36. The method of claim 31, wherein illuminating the one or more second regions further comprises modulating the second light source for controlling a size and/or location of the one or more second regions.

37. The method of claim 31, wherein a size of the one or more first regions in a direction parallel to the rotational axis is a sub-pixel size and/or a size of the one or more second regions in a direction perpendicular to the rotational axis is a sub-pixel size.

38. An imaging method comprising:

illuminating one or more first regions of a photoconductor drum at a first illumination level that is below an illumination level for repelling a marking material by scanning the photoconductor drum parallel to a rotational axis of the drum using a first light source; and illuminating one or more second regions of the photoconductor drum at a second illumination level that is below the illumination level for repelling the marking material by rotating the drum past a second light source so that the drum is scanned in a direction substantially perpendicular to the rotational axis, wherein at least a portion of each of the one or more first and second regions overlap.

39. The method of claim 38, wherein the first and second illumination levels of the overlapped portion of each of the one or more first and second regions combine to produce an illumination level sufficient for repelling the marking material, thereby causing the marking material to be repelled from the overlapped portion of each of the one or more first and second regions.

40. The method of claim 38, wherein the first light source is a laser beam.

41. The method of claim 38, wherein the second light source comprises a plurality of light emitting diodes, wherein one or more of the light emitting diodes respectively illuminate the one or more second regions of the photoconductor drum.

42. A computer-usable medium containing computer-readable instructions for causing an imaging device to perform an imaging method comprising:

forming one or more marking-material-free regions or one or more marking-material-containing regions on a photoconductor only at locations of the photoconductor that have been exposed at least twice to light having an intensity below a threshold sufficient to produce a marking-material-free region or a marking material containing region.

43. The computer-usable medium of claim 42, wherein, in the method, the locations of the photoconductor that have been exposed to light at least twice are exposed to substantially perpendicular scans of light.

44. The computer-usable medium of claim 43, wherein, in the method, one of the scans of light is a laser scan and another of the scans of light is a light-emitting-diode scan.

45. The computer-usable medium of claim 44, wherein, in the method, the laser scan comprises modulating a laser beam.

46. The computer-usable medium of claim 44, wherein, in the method, the light-emitting-diode scan comprises modulating light emitting diodes.

47. The computer-usable medium of claim 42, wherein, in the method, the photoconductor is disposed on a rotatable drum.

48. The computer-usable medium of claim 42, wherein, in the method, forming one or more marking-material-free regions further comprises repelling the marking-material from the locations of the photoconductor that have been exposed to light at least twice.

49. The computer-usable medium of claim 42, wherein, in the method, forming one or more marking-material-containing regions further comprises attracting the marking material to the locations of the photoconductor that have been exposed to light at least twice.

50. A computer-usable medium containing computer-readable instructions for causing an imaging device to perform an imaging method comprising:

illuminating a region of a photo conductor with light emitting diode (LED) light with an intensity insufficient for attracting toner; and illuminating at least part of the region of the photoconductor illuminated with the light emitting diode light with laser light.

51. The computer-usable medium of claim 50, wherein the method further comprises depositing marking material onto the at least part of the region of the photoconductor illuminated by the LED light and the laser light.

52. The computer-usable medium of claim 50, wherein, in the method, the laser light illumination is done before the LED illumination.

53. The computer-usable medium of claim 50, wherein, in the method, the LED illumination is done before the laser light illumination.

54. The computer-usable medium of claim 50, wherein the method further comprises depositing marking material onto areas of the photoconductor that have not been illuminated by the LED light and laser light.

55. The computer-usable medium of claim 50, wherein, in the method, illuminating the region of the photoconductor illuminated with the light emitting diode light with the laser light includes using an intensity of the laser light to cause discharge insufficient for depositing marking material on a part of the region of the photoconductor exposed to the laser light but not exposed to the LED light.

56. The computer-usable medium of claim 50, wherein, in the method, illuminating the region of the photoconductor with the LED light includes using an intensity of the LED light to cause discharge insufficient for depositing marking material on a part of the region of the photoconductor exposed to the LED light but not exposed to the laser light.

57. The computer-usable medium of claim 50, wherein, in the method, a scan axis of the laser light and a scan axis of the LED light are substantially perpendicular.

58. The computer-usable medium of claim 50, wherein, in the method, the photoconductor includes a photoconductor drum with a scan axis of the laser light parallel to a photoconductor drum axis and a scan axis of the LED light perpendicular to the photoconductor drum axis.

59. A computer-usable medium containing computer-readable instructions for causing an imaging device to perform an imaging method comprising:

illuminating one or more first regions of a photoconductor at a first illumination level less than an illumination level for depositing marking material on the photoconductor; and illuminating one or more second regions of the photoconductor at a second illumination level less than the illumination level for depositing the marking material on the photoconductor, wherein at least a portion of each of the one or more first and second regions overlap.

60. The computer-usable medium of claim 59, wherein, in the method, the illuminating one or more first regions of a photoconductor further comprises using a laser beam.

61. The computer-usable medium of claim 60, wherein, in the method, the illuminating one or more first regions of a photoconductor further comprises modulating the laser beam to control a size of the one or more first regions and/or to control a location of the one or more first regions relative to the one or more second regions.

62. The computer-usable medium of claim 60, wherein, in the method, the illuminating one or more second regions of a photoconductor further comprises using light emitting diodes.

63. The computer-usable medium of claim 62, wherein, in the method, the illuminating one or more second regions of a photoconductor further comprises modulating the light emitting diodes to control a size of the one or more second regions and/or to control a location of the one or more second regions relative to the one or more first regions.

64. The computer-usable medium of claim 59, wherein, in the method, the photoconductor is disposed on a rotatable drum.

65. The computer-usable medium of claim 64, wherein, in the method, the illuminating one or more first regions of a photoconductor further comprises scanning the photoconductor in a direction parallel to a rotational axis of the drum.

66. The computer-usable medium of claim 65, wherein, in the method, the illuminating one or more second regions of a photoconductor comprises scanning the photoconductor in a direction perpendicular to the rotational axis of the drum.

67. The computer-usable medium of claim 59, wherein, in the method, the first and second illumination levels of the overlapped portion of each of the one or more first and second regions combine to equal or exceed the illumination level for depositing marking material on the photoconductor.

68. The computer-usable medium of claim 67, wherein the method further comprises depositing marking material adjacent the overlapped portion of each of the one or more first and second regions.

69. The computer-usable medium of claim 68, wherein, in the method, depositing marking material adjacent the overlapped portion of each of the one or more first and second regions comprises the marking material being repelled from the overlapped portion of each of the one or more first and second regions and attracted to non-overlapping portions of each of the one or more first and second regions and adjacent regions that have not been illuminated.

70. The computer-usable medium of claim 67, wherein the method further comprises depositing marking material onto the overlapped portion of each of the one or more first and second regions.

71. The computer-usable medium of claim 70, wherein, in the method, depositing marking material onto the overlapped portion of each of the one or more first and second regions comprises the marking material being attracted to the overlapped portion of each of the one or more first and second regions.

72. An apparatus, comprising:

a laser light source configured to illuminate a region of a photoconductor; and a plurality of light emitting diodes configured to illuminate at least part of the region illuminated with the laser light source with an intensity of light insufficient for attracting toner.

73. The apparatus of claim 72, wherein the laser light source is further configured to illuminate the region with an intensity of light insufficient for attracting toner.

74. The apparatus of claim 72, wherein the laser source and the plurality of light emitting diodes are configured to scan in perpendicular directions.

75. The apparatus of claim 72, wherein the laser source and/or the plurality of light emitting diodes are configured for modulation.

76. An imaging device comprising:

a photoconductor;

a first light source adapted to illuminate one or more first regions of the photoconductor at a first illumination level below an illumination level for forming marking material on the photoconductor; and a second light source adapted to illuminate one or more second regions of the photoconductor at a second illumination level below the illumination level for forming the marking material on the photoconductor, wherein at least a portion of each of the one or more first and second regions overlap;

wherein the first and second illumination levels in combination are sufficient for forming a dot of the marking material on the photoconductor.

77. The imaging device of claim 76, wherein the first and second light sources are further adapted to scan the photoconductor in perpendicular directions.

78. The imaging device of claim 76, wherein the first light source is a laser.

79. The imaging device of claim 78, wherein the second light source comprises a plurality of light emitting diodes.

80. The imaging device of claim 76, wherein the photoconductor is disposed on a rotatable drum.

81. An imaging device comprising:

a rotatable photoconductor drum;

a first light source adapted to illuminate one or more first regions of the photoconductor drum at a first illumination level that is below an illumination level for forming a dot of marking material on the photoconductor drum while scanning the drum parallel to a rotational axis of the drum; and a second light source adapted to illuminate one or more second regions of the photoconductor drum at a second illumination level that is below the illumination level for forming a dot of the marking material on the photoconductor drum while the drum rotates past the second Tight source, wherein at least a portion of each of the one or more first and second regions overlap;

wherein the first and second illumination levels in combination are sufficient for forming a dot of the marking material on the photoconductor drum.

82. The imaging device of claim 81, wherein the first light source is a laser.

83. The imaging device of claim 82, wherein the second light source comprises a plurality of light emitting diodes.

84. An imaging device comprising:

a means for illuminating one or more first regions of a photo conductor at a first illumination level that is less than an illumination level for depositing marking material on the photoconductor; and a means for illuminating one or more second regions of the photoconductor a second illumination level that is less than the illumination level for depositing the marking material on the photoconductor, wherein at least a portion of each of the one or more first and second regions overlap.

85. The imaging device of claim 84 further comprises a means for moving the photoconductor past the means for illuminating one or more second regions of the photoconductor.

86. The imaging device of claim 84 further comprises a means for aligning the means for illuminating one or more first regions of the photoconductor and the means for illuminating one or more second regions of the photoconductor.

87. The imaging device of claim 84, wherein the first and second illumination levels of the overlapped portion of each of the one or more first and second regions combine to produce an illumination level sufficient for depositing the marking material on the photoconductor.

* * * * *

UNITED STATES PATENT AND TRADEMARK OFFICE

CERTIFICATE OF CORRECTION

PATENT NO. : 7,358,980 B2
APPLICATION NO. : 11/041775
DATED : April 15, 2008
INVENTOR(S) : Bradley R. Larson It is certified that error appears in the above-identified patent and that said Letters Patent is hereby corrected as shown below:

In column 1, line 62, delete "10" and insert -- 110 --, therefor.

In column 7, line 13, in Claim 10, after "claim 9" delete ",".

In column 10, line 14, in Claim 50, delete "photo conductor" and insert -- photoconductor --, therefor.

In column 12, line 47, in Claim 81, delete "Tight" and insert -- light --, therefor.

In column 12, line 59, in Claim 84, delete "photo conductor" and insert -- photoconductor --, therefor.

Signed and Sealed this

Fifth Day of August, 2008

JON W. DUDAS
*Director of the United States Patent and Trademark Office*